US006337168B1

(12) United States Patent
Almog

(10) Patent No.: US 6,337,168 B1
(45) **Date of Patent: *Jan. 8, 2002**

(54) TONER PARTICLES WITH MODIFIED CHARGEABILITY

(75) Inventor: Yaacov Almog, Rehovot (IL)

(73) Assignee: Indigo N. V. (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/987,591

(22) Filed: Dec. 9, 1997

Related U.S. Application Data

(63) Continuation of application No. 08/583,009, filed as application No. PCT/NL93/00181 on Sep. 6, 1993, now abandoned.

(30) Foreign Application Priority Data

Aug. 2, 1993 (IL) ..... 106571

(51) Int. Cl.[7] ..... G03G 9/135

(52) U.S. Cl. ..... 430/114; 430/115; 430/126; 430/137.11; 430/137.22

(58) Field of Search ..... 430/114, 115, 430/126, 137, 137.22, 137.11

(56) References Cited

U.S. PATENT DOCUMENTS

| | | | | |
|---|---|---|---|---|
| 3,078,231 A | | 2/1963 | Metcalfe et al. | |
| 3,325,409 A | | 6/1967 | Whitbread | |
| 3,438,904 A | | 4/1969 | Wagner | |
| 3,507,679 A | | 4/1970 | Metcalfe et al. | |
| 3,977,983 A | | 8/1976 | Tsuneda | |
| 4,259,428 A | | 3/1981 | Tsuneda | |
| 4,526,852 A | | 7/1985 | Herrmann et al. | |
| 4,639,404 A | | 1/1987 | Uytterhoeven et al. | |
| 5,254,424 A | * | 10/1993 | Felder | 430/114 |
| 5,264,553 A | | 11/1993 | Hou | |
| 5,270,445 A | | 12/1993 | Hou | |
| 5,306,590 A | * | 4/1994 | Felder | 430/115 |
| 5,306,591 A | * | 4/1994 | Larson et al. | 430/115 |
| 5,459,007 A | * | 10/1995 | Larson et al. | 430/115 |

FOREIGN PATENT DOCUMENTS

| | | |
|---|---|---|
| DE | 2521917 | 12/1975 |
| EP | 176630 | 4/1984 |
| WO | 92-13027 | 8/1992 |

OTHER PUBLICATIONS

Schaffert, R.M. Electrophotography. New York: John Wiley & Sons. pp. 69–73, 1975.*

Written Opinion mailded May 10, 1995, PCT/NL93/00181.

The Response to the Written Opinion dated Aug. 10, 1995, PCT/NL93/00181.

International Preliminary Examination Report, PCT/NL93/00181 (No Date).

International Search Report and Annex, PCT/NL93/00181 (No Date).

Grant & Hackh's Chemical Dictionary, Roger and Claire Grant, New York: McGraw–Hill, Inc. p. 309. (1987).

Diamond, Arthur S. (editor), Handbook of Imaging Materials, New York: Marcel Dekker, Inc. p. 233. (1991).

* cited by examiner

*Primary Examiner*—Christopher Rodee
(74) *Attorney, Agent, or Firm*—Kenyon & Kenyon

(57) ABSTRACT

A liquid toner for electrostatic imaging which includes: an insulating non-polar carrier liquid, at least one charge director and toner particles dispersed in the carrier liquid. The particles include a core material which is unchargeable or weakly chargeable by the at least one charge director, but which is otherwise suitable for use as a toner material and a coating of at least one ionomer component in an amount effective to impart enhanced chargeability to the ordinarily unchargeable or weakly chargeable particles.

32 Claims, 4 Drawing Sheets

TONER PARTICLES WITH MODIFIED CHARGEABILITY

CROSS REFERENCE TO RELATED APPLICATIONS

This application is a continuation of application Ser. No. 08/583,009, filed Jan. 1, 1996, now abandoned, which is the U.S. National Stage of International Application No. PCT/NL93/00181, filed Sep. 6, 1993. The entire disclosure of application Ser. No. 08/583,009 is considered as being part of the disclosure of this application, and the entire disclosure of application Ser. No. 08/583,009 is expressly incorporated by reference herein in its entirety.

FIELD OF THE INVENTION

This invention relates to the field of electrostatic imaging and, more particularly, to the preparation of liquid toners containing components for imparting chargeability to ordinarily unchargeable liquid toner particles, enhancing the chargeability of insufficiently chargeable liquid toner particles, and controlling the polarity of liquid toner particle charge.

BACKGROUND OF THE INVENTION

In the art of electrostatic photocopying or photoprinting, a latent electrostatic image is generally produced by first providing a photoconductive imaging surface with a uniform electrostatic charge, e.g. by exposing the imaging surface to a charge corona and then selectively discharging the surface by exposing it to a modulated beam of light corresponding, e.g., to an optical image of final image to be produced. This forms a latent electrostatic image having a "background" portion at one potential and a "print" portion at another potential. The latent electrostatic image can then be developed by applying to it charged pigmented toner particles, which adhere to the print portions of the photoconductive surface to form a toner image which is subsequently transferred by various techniques to a final substrate (e.g. paper).

It will be understood that other methods may be employed to form an electrostatic image, such as, for example, providing a carrier with a dielectric surface and transferring a preformed electrostatic charge to the surface. The charge may be formed from an array of styluses. It is to be understood that the invention is applicable, generally to both printing and copying systems.

In liquid-developed electrostatic imaging, the toner particles are usually dispersed in an insulating non-polar liquid carrier such as an aliphatic hydrocarbon fraction, which generally has a high-volume resistivity above $10^9$ ohm cm, a dielectric constant below 3.0 and a low vapor pressure (less then 10 torr. at 25° C.). The liquid developer system further comprises so-called charge directors, i.e. compounds capable of imparting to the toner particles an electrical charge of the desired polarity and uniform magnitude.

In the course of the process, liquid developer is applied to the photoconductive imaging surface. Under the influence of the electrical potential present in the latent image and a developing electrode which is usually present, the charged toner particles in the liquid developer migrate to the print portions of the latent electrostatic image, thereby forming the developed toner image.

Charge director molecules play an important role in the above-described developing process in view of their function of controlling the polarity and magnitude of the charge on the toner particles. The choice of a particular charge director for use in a specific liquid developer system, will depend on a comparatively large number of physical characteristics of the charge director compound, inter alia its solubility in the carrier liquid, its chargeability, its high electric field tolerance, its release properties, its time stability, the particle mobility, etc., as well as on characteristics of the toner and the development apparatus. All these characteristics are crucial to achieve high quality imaging, particularly when a large number of impressions are to be produced.

A wide range of charge director compounds for use in liquid-developed electrostatic imaging are known from the prior art. Examples of charge director compounds are ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinyl-pyrrolidone, organic acid esters of polyvalent alcohols, etc.

Desired physical characteristics of toner particles is that they have softening points consistent with the temperature capabilities of the final substrate, good adhesion to the substrate and abrasive resistance. To this end toner particles are often formed of polymer materials having these properties and having pigments dispersed therein or which are otherwise colored.

Unfortunately, many polymers which would make ideal toner materials are difficult if not impossible to charge to a level which is useful in an electrostatic imaging process.

U.S. Pat. No. 4,526,852 (Herrmann et al) used a particulate acid or ester wax derived from montan wax, hydrated castor oil or polyoctadecene to reduce the specific electrical conductivity of a liquid developer containing negatively charged toner particles.

Notwithstanding the undoubted utility of charge directors, and the various attempts which have been made to improve their performance, from one aspect their use depends on the toner particles having a surface which is receptive to the application of charge directors. In other words, the art would have considered certain types of particles either virtually unchargeable or insufficiently chargeable. Moreover, it may be desirable to change the polarity of the charged particles from that which is conventionally associated with a particular charge director, when used in conjunction with a particular type of toner particle.

SUMMARY OF THE INVENTION

It is an object of the present invention to provide improved liquid toner compositions containing charge directors, which address the problems mentioned in the preceding paragraph. Other objects of the invention will appear from the description which follows.

The present invention accordingly provides in one aspect, a liquid toner for electrostatic imaging which comprises:

- an insulating non-polar carrier liquid;
- at least one charge director; and
- toner particles dispersed in the carrier liquid, the particles comprising:
  - a core material which is unchargeable or weakly chargeable by the at least one charge director, but which is are otherwise suitable for use as a toner material; and
  - a coating of at least one ionomer component in an amount effective to impart enhanced chargeability to the ordinarily unchargeable or weakly chargeable particles.

In a second aspect of the invention, there is provided liquid toner for electrostatic imaging which comprises:

an insulating non-polar carrier liquid;

at least one charge director; and toner particles dispersed in the carrier liquid, the toner particles comprising:

a core material which is chargeable to a first polarity by the at least one charge director; and a coating of at least one ionomer component in an amount effective, together with the at least one charge director, to impart a charge having a polarity different from the first polarity to the coated particles.

In a further aspect of the invention, a method of producing liquid toner for electrostatic imaging, which method comprises dispersing particles in an insulating non-polar carrier liquid, and mixing also at least one ionomer with the liquid. Preferably, the mixture is first heated to a temperature at which the ionomer dissolves in the carrier liquid and then cooled to a temperature whereat the ionomer is not soluble in the carrier liquid, thereby coating the particles with ionomer material.

In a preferred embodiment of the invention, the mixture is agitated at least during the step of cooling.

Preferably, at least one charge director is added to the mixture, most preferably after the step of cooling.

According to a preferred embodiment of the invention, the particles are formed of a material which, in the presence of charge director alone, is ordinarily unchargeable or weakly chargeable, but is otherwise suitable for use as toner particles, and the at least one ionomer component is used in an amount effective to impart enhanced chargeability to the toner particles.

In a preferred embodiment of the invention, the at least one ionomer component is used in an amount effective to reverse the polarity conventionally imparted to the material of the particles by the at least one charge director.

In still another aspect, the present invention provides an electrostatic imaging process which comprises the steps of: forming a charged latent electrostatic image on a photoconductive surface; applying to said surface charged colorant particles from a liquid toner of the invention (or as prepared by the method of the invention); and transferring the resulting toner image to a substrate.

Generally, the ionomers utilized as coatings in the Examples herein are low molecular weight ionomers which are generally considered to be too soft to be used alone for toner materials.

BRIEF DESCRIPTION OF THE DRAWINGS

The present invention will be understood and appreciated more fully from the following detailed description of the preferred embodiments thereof, taken in conjunction with the drawings in which.

DETAILED DESCRIPTION OF THE INVENTION

Figure 1:
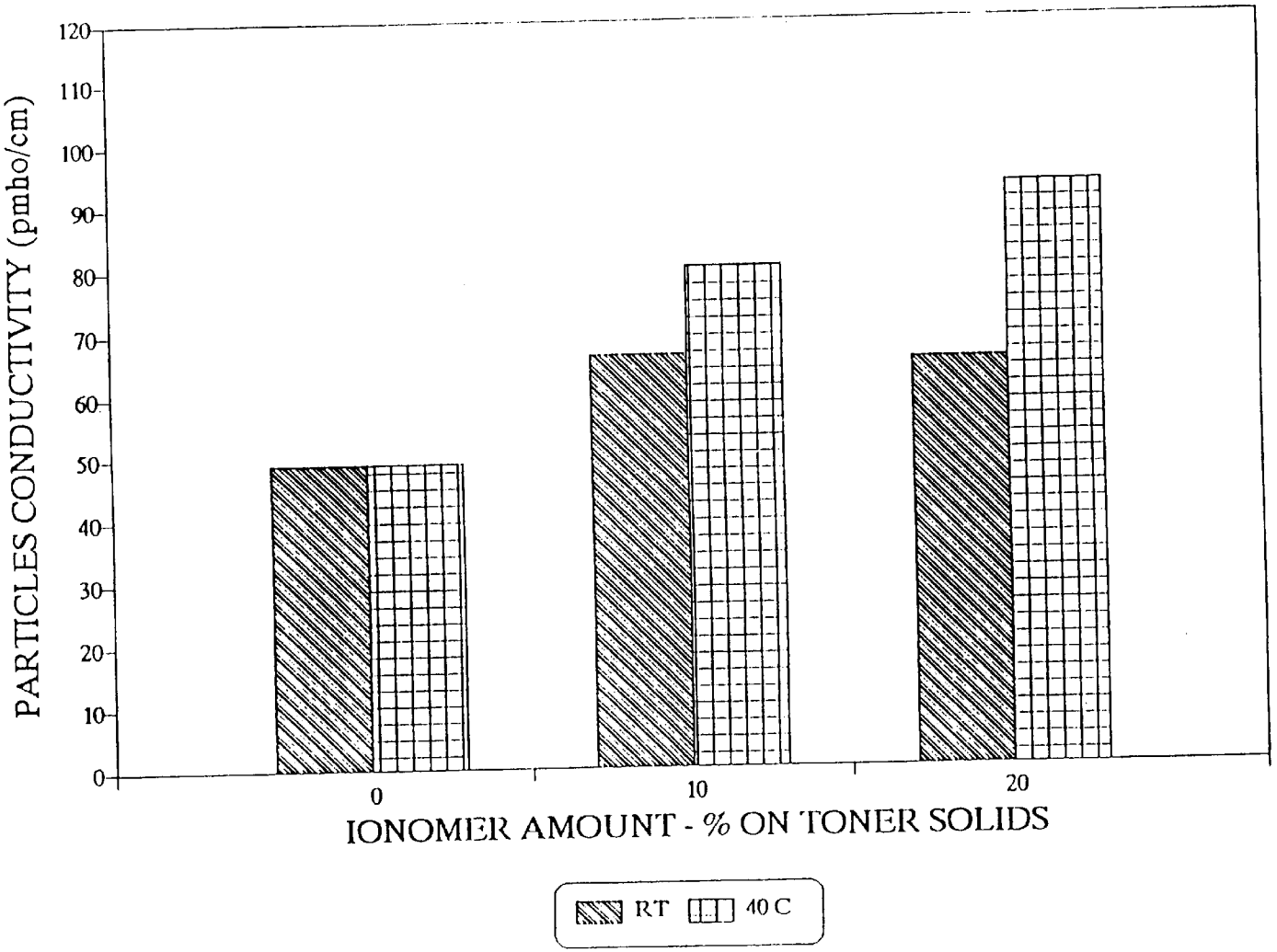
FIG. 1 shows the effect of A 291 ionomer used in accordance with an embodiment of the invention on the chargeability of tentacular toner particles.

In a particular preferred embodiment of the invention, the toner particles are defined as ordinarily unchargeable, that is to say that they would be regarded as unchargeable by the skilled person, in absence of a knowledge of the present invention, and the ionomer is used in an amount effective to impart chargeability to the toner particles.

In another preferred embodiment of the invention, the toner particles are defined as weakly chargeable, that is to say that although the skilled person would be aware that a weak charge could be imparted to the particles it would be apparent that this property would be of little or no utility so far as practical applications in electrostatic imaging were concerned. In this case, the ionomer is used in an amount effective to impart enhanced chargeability to the toner particles.

In yet another preferred embodiment of the invention, the ionomer is used in an amount effective to reverse the polarity known by the skilled person to be conventionally imparted to the toner particles by the at least one charge director. In this connection, for example, resinous toner particles containing carboxylic acid groups would be conventionally expected to be negatively chargeable because of their potential to lose carboxylic hydrogen atoms as protons leaving residual anionic carboxylate groups or to form a salt with potential loss of the cation leaving a carboxylate anion. Conversely, for example, resinous toner particles containing di-amino groups would be conventionally expected to be positively chargeable because of their potential to add protons, forming resin particle-attached quaternary ammonium groups.

In yet another preferred embodiment of the invention, the "core" of the particles comprise a pigmented polymer. As is well known in the art, the chargeability of polymer materials is dependent on the pigment used to color the particles. When the particles are coated by an ionomer, or by an uncolored layer of some other chargeable polymer, the chargeability is the same for all colors.

The toner particles, insulating non-polar carrier liquids, colorant particles and charge directors, which may suitably be used in the liquid toners and the compositions of the invention may be those known in the art. Illustratively, the insulating non-polar liquid carrier, which should preferably also serve as carrier for the charge directors, is most suitably a hydrocarbon fraction, particularly an aliphatic hydrocarbon fraction, having suitable electrical and other physical properties. More particularly, the carrier is preferably an insulating non polar carrier liquid hydrocarbon having a volume resistivity above $10^9$ ohm-cm and a dielectric constant below 3.0. Preferred solvents are the series of branched-chain aliphatic hydrocarbons and mixtures thereof, e.g. the isoparaffinic hydrocarbon fractions having a boiling range above about 155° C., which are commercially available under the name Isopar (a trademark of the Exxon Corporation).

The toner particles may be, e.g., thermoplastic resin particles as is known in the art. Alternatively, the skilled person would be able to select toner particles made from a particulate substance not hitherto regarded as chargeable by the use of charge directors, in relation to electrostatic imaging applications, but whose physical and chemical properties make them otherwise suitable, for the purpose of charging them by use of ionomers and charge directors in accordance with the present invention.

The ionomers utilized in a preferred embodiment of the present invention are those which are soluble in the carrier liquid at elevated temperatures and are less soluble at ambient temperatures, so that on mixing the components mentioned hereinbelow including the ionomer, at temperatures above ambient temperatures, the ionomer dissolves in the carrier liquid and then, when cooling the mixture, the ionomer will be deposited as a coating on the toner particles. The ionomers should preferably have a relatively low molecular weight to produce the above referenced solubility characteristics and also to provide a low viscosity.

Suitable ionomers for use in the present invention are e.g. those marketed by Allied Signal under the registered Trade Mark "AClyn", which are described as low molecular weight ethylene-based copolymers neutralized with metal salts forming ionic clusters. Examples of these are shown in Table 1.

The ionomers listed in Table 1 are based on metacrylic acid. However, ionomers based on other carboxylic acids or on other organic acids such as sulfonic and phosphoric acids are also believed to be useful in the present invention. Furthermore, non-ethylene based ionomers are also believed to be useful in the present invention, if they have the other characteristics defined in the preceding paragraph.

TABLE 1

AClyn Low Molecular Weight Ionomers

| Properties: | | (1) Acid | (2) Melt | (3) | (4) Part. | (5) Low Field |
|---|---|---|---|---|---|---|
| Code | Cation | No. | Point, ° C. | Viscosity | Cond. | Cond. |
| 201A | Ca | 42 | 102 | 5,500 | 65 | 11 |
| 246A | Mg | 0 | 95 | 7,000 | 63 | 17 |
| 276A | Na | 0 | 98 | 70,000 | 239 | 23 |
| 290 | Zn | 60 | 99 | 900 | 209 | 14 |
| 291A | Zn | 40 | 102 | 5,500 | 304 | 23 |
| 293A | Zn | 30 | 101 | 500 | 162 | 16 |
| 295A | Zn | 0 | 99 | 4,500 | 116 | 12 |

Notes to Table 1:
(1) in units of mg KOH/g;
(2) per ASTM-D 633;
(3) cps at 190° C.;
(4) and (5) conductivity of 1% n.v.s micro-dispersion in ISOPAR L; The materials were prepared by grinding a 20% nonvolatile solids mixture (in Isopar-L) in an attritor for 24 hours (the resulting particle size is between 0.8 and 1.5 micrometers) and charged with 100 mg/g of Lubrizol 890 (Lubrizol Corp.). The high field conductivity is measured at 1.5 V/micrometer (DC) and the low field conductivity (5) at 5 V/mm at 5 Hz. The particle conductivity, (4) is defined as the difference between the high and low field conductivities and is a measure of the conductivity of the particles alone (without the conductivity of the carrier liquid).

ISOPAR L; The materials were prepared by grinding a 20% non-volatile solids mixture (in Isopar -L) in an attritor for 24 hours (the resulting particle size is between 0.8 and 1.5 micrometers) and charged with 100 mg/g of Lubrizol 890 (Lubrizol Corp.). The high field conductivity is measured at 1.5 V/micrometer (DC) and the low field conductivity (5) at 5 V/mm at 5 Hz. The particle conductivity, (4) is defined as the difference between the high and low field conductivities and is a measure of the conductivity of the particles alone (without the conductivity of the carrier liquid).

The invention will be illustrated by the following non-limiting Examples.

EXAMPLE 1

Toner Containing Carboxylic Copolymer Paritcles (a) 7.5 kg of a thermoplastic ethylene/methacrylic acid/isobutyl methacrylate copolymer marketed as Elvax 5650T (E.I. du Pont) and 7.5 kg Isopar L (Exxon) are mixed for one hour at speed 2 in a Ross double planetary mixer (10 gallon LDM) for one (1) hour, at a controlled temperature of 150° C., followed by addition of 15 kg Isopar L preheated at 90° C. and further mixing at speed 5 for one (1) hour. The mixture is cooled to room temperature while mixing at speed 3.

(b) 10.44 kg of the product of part (a) is transferred to an S-15 attritor (Union Process, Inc., Akron, Ohio) together with 390 g of FG 7351 cyan pigment, 45 g aluminum stearate and 9.125 kg Isopar L. The mixture is ground for 2 hours at speed 6, at 54° C., after which 10 kg Isopar L is added and grinding is effected for a further 38 hours, to produce a dispersion of 1.6 micrometer diameter tentacular particles.

Figure 2:
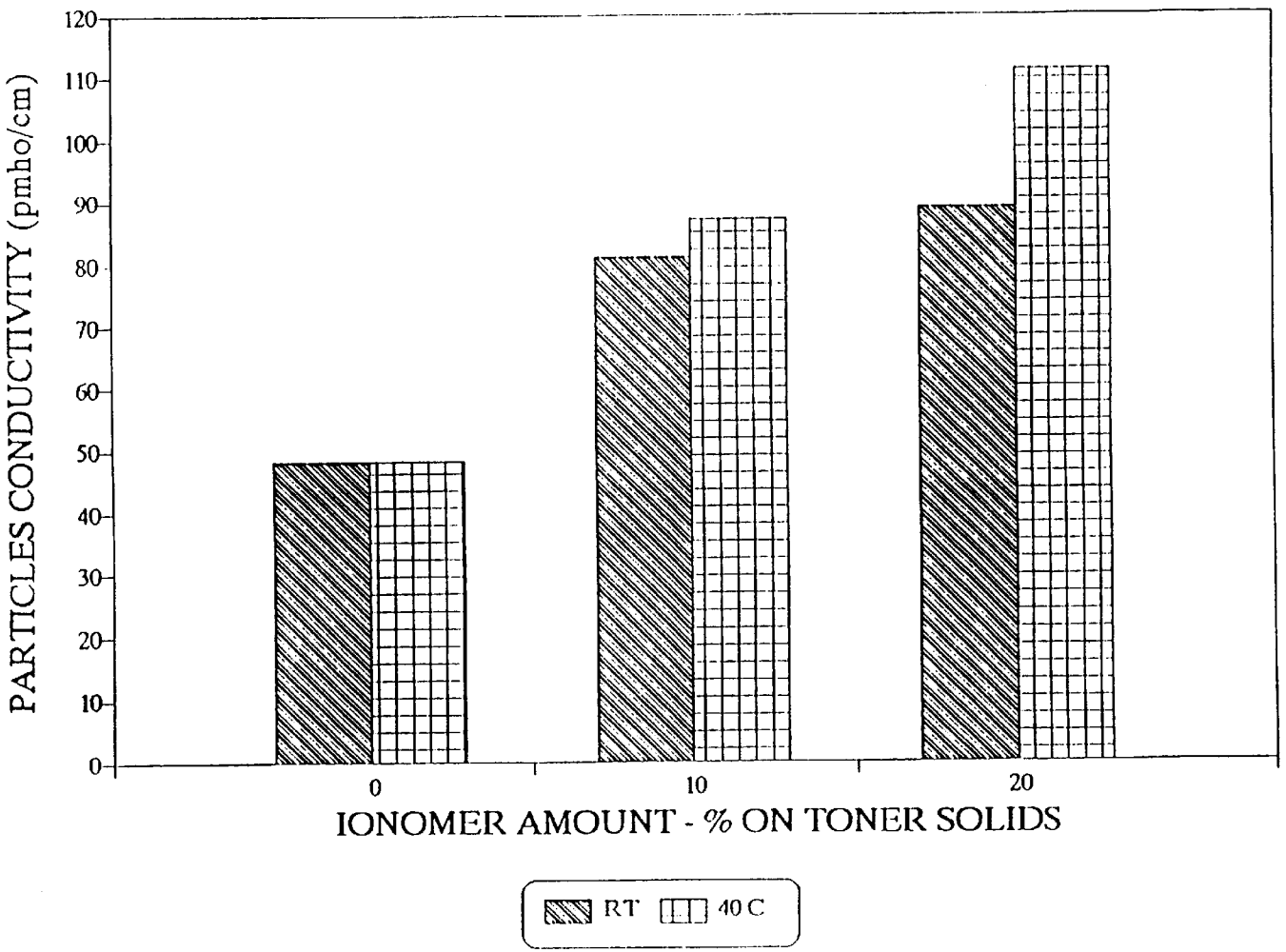
FIG. 2 shows the effect of A 290 ionomer used in accordance with an embodiment of the invention on the chargeability of tentacular toner particles.
Figure 3:
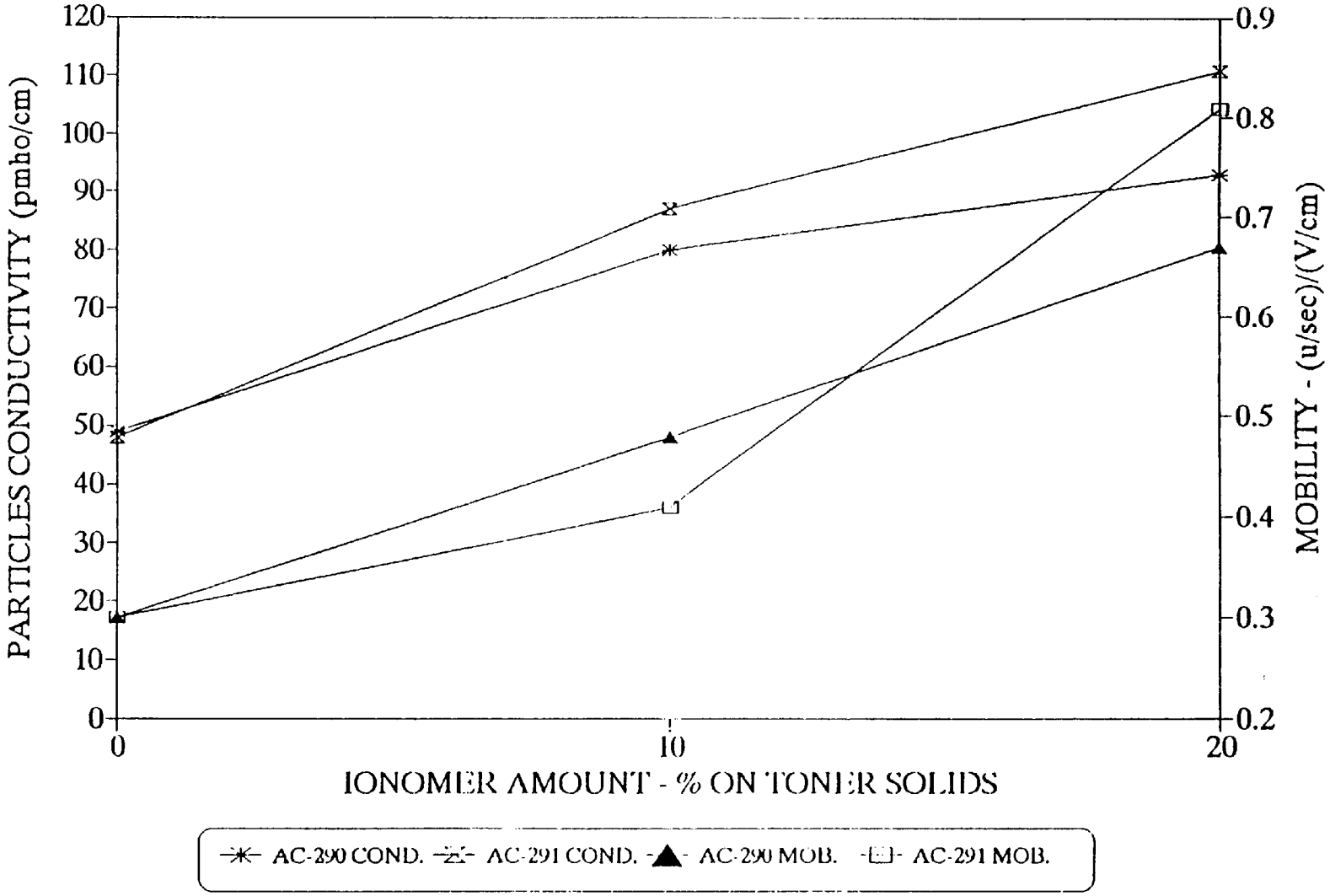
FIG. 3 shows the effect of both A 290 and A 291 on the mobility of toner particles at 40° C.

(c) The product of part (b) (300 g diluted to 2% n.v.s.) is placed in a vessel, subjected to the action of a Ross Model Lab-ME high shear mixer at room temperature, and an Isopar L solution of 10% by weight ionomer (AClyn 290 or 291A, preheated at 115° C., the ionomer constituting either 10 or 20% by weight of the toner solids), is slowly added, after which maximum shear is applied for 3 minutes. The dispersion is allowed to equilibrate for 1 hour and then Lubrizol 890 (a polyisobutenyl-succinimide dispersant additive) is added in an amount of 100 mg charge director per gram of toner solids; the product is then allowed to equilibrate for a further 2 hours, after which time the charging parameters are measured. In an alternative procedure in step (c), the initial shear may be conducted e.g. at 40° C. instead of room temperature. Results are shown in FIGS. 1–3, from which it may be seen that use of the ionomer increases both the particle conductivity and the mobility of the toner particles. FIGS. 1 and 2 show the effect of A 290 and A 291 respectively on conductivity and FIG. 3 shows the effect of both materials on conductivity and mobility at 40° C.

EXAMPLE 2

Spherical Toner Particles (a) Preparation of Intermediate Dispersed Phase

Dynapol S-1228 (120 g) is loaded onto the rolls of a Brabender 2-roll mill preheated by an oil heating unit to 100° C., and aluminum tristearate (2.4 g) and blue pigment BT 583D (30 g) are added thereto, at a speed of 60 rpm and a torque of 40 Nm. After about 20 minutes the material is discharged and shredded into small pieces.

(b) Preparation of Caramel

White sugar (3 kg) is stirred in a Ross double planetary mixer over a three (3) hour period as set forth in Table 2:

TABLE 2

Preparation of Caramel

| Time (mins): | 0 | 20 | 55 | 115 | 145 | 175 |
|---|---|---|---|---|---|---|
| batch temp (° C.) | — | 126 | 150 | 165 | 170 | 176 |
| oil temp (° C.) | 190 | 190 | 190 | 190 | 195 | 195 |
| mixer speed | 1 | 1 | 1 | 6 | 6 | 6 |

The product is discharged while warm into Teflon-coated aluminum pans, and after cooling is broken up into small pieces.

(c) Preparation of Toner Concentrate

The products from steps (a) (400 g) and (b) (600 g) are stirred in a Kenwood mixer vessel, electrically heated by means of a tape controlled by a thermocouple set at 160° C. The melt is allowed to cool gradually to 106° C., then the material is discharged and after cooling is pulverized to 4.0 μm median diameter. The product is washed with water to remove undissolved caramel, then washed with isopropyl alcohol to remove water, the solvent being finally replaced by Peneteck (Penerco) to obtain a 50% n.v.s. concentrate.

(d) Preparation of Liquid Toner

The product from step (c) is diluted to 2% n.v.s. with Isopar L, 300 g of the diluted dispersion is heated to 40° C. and is placed in a vessel, subjected to the action of a Ross Model Lab-ME high shear mixer at room temperature, and an Isopar L solution of 10% by weight ionomer (AClyn 291A, preheated at 115° C., the ionomer constituting 5, 10 or 20% by weight of the toner solids), is slowly added, after which maximum shear is applied for 3 minutes. The dispersion is allowed to equilibrate for 1 hour and to cool to room temperature. Lubrizol 890 is added in an amount of 100 mg charge director per gram of toner solids. The product is then allowed to equilibrate for a further 2 hours, after which time the charging parameters are measured. Results are shown in Table 3.

TABLE 3

Conductivity of Spherical Toner Particles with Lubrizol 890 Charge Director

| Run No. | % A291A | particle conductivity (pmho/cm) |
|---|---|---|
| 1 | 0 | 3 |
| 2 | 5 | 115 |
| 3 | 10 | 162 |
| 4 | 20 | 164 |

Figure 4:
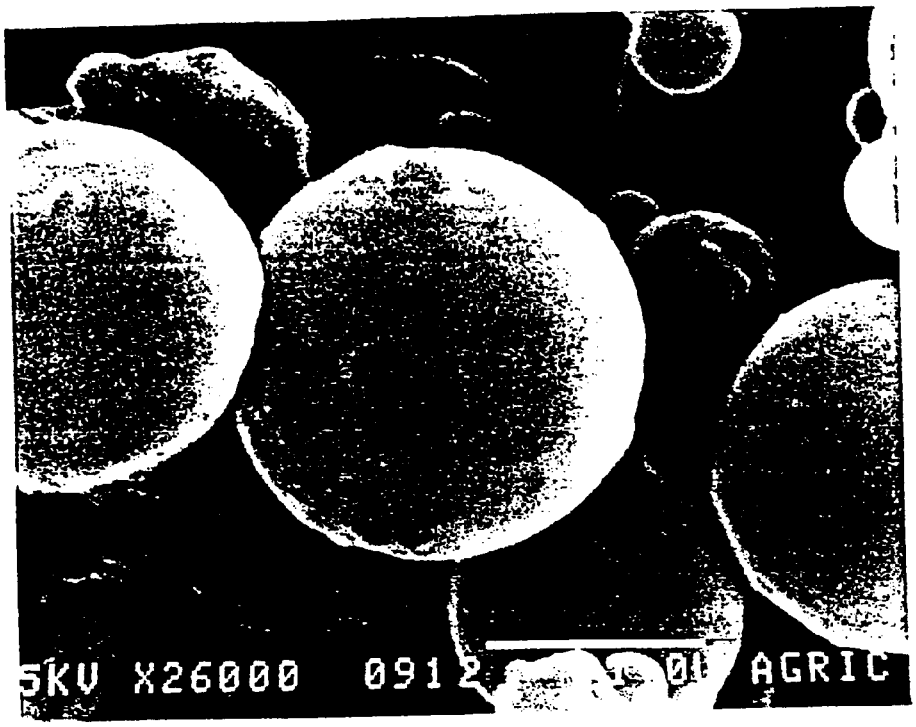
FIGS. 4 and 5 show electron-micrographs of spherical toner particles in accordance with a preferred embodiment of the invention.
Figure 5:
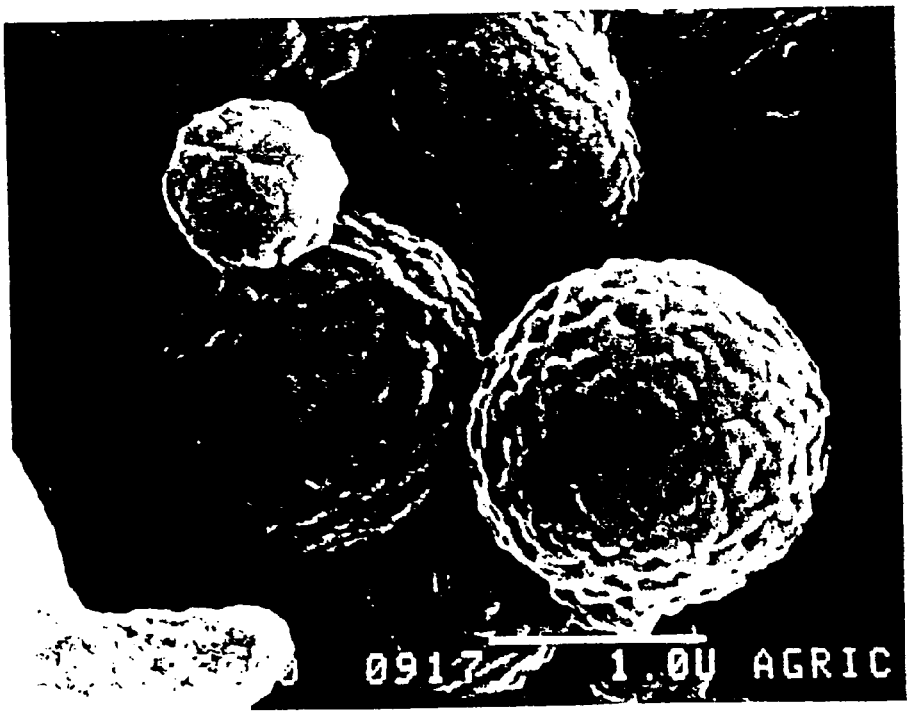

FIGS. 4 and 5 show SEM electron-micrographs of the toner particles of run 1 and 4 respectively.

A calculation of the thickness of the coating based on the percentage of A291A and the measured diameter of the particles shows that the particles of run 1 have a coating of the order of 0.023 micrometers. As can be seen above even such a thin coating (on the average 2–5 times a mono-layer) results in decided improvement in the conductivity, although not in optimal results. This is believed to be due to unevenness of the coating as shown in FIG. 5. It is believed that a thinner, more even coating, even perhaps as thin as a single monolayer, would result in marked improvement of the conductivity.

EXAMPLE 3

Spherical Toner Particles

The product of step (c) of Example 2 is diluted to 4% n.v.s. with Marcol 82 (Exxon), a highly refined petroleum oil, 300 g of the diluted dispersion is preheated to 40° C., placed in a vessel, subjected to the action of a Ross Model Lab-ME high shear mixer, Marcol 82 solution of 10% by weight ionomer (AClyn 293A, preheated at 115° C., the ionomer constituting 5% by weight of the toner solids), is slowly added, after which maximum shear is applied for 3 minutes. The mixture is allowed to cool to room temperature and the dispersion is allowed to equilibrate for at least 3 hours. Then aluminum tributoxide (Aldrich) is added in an amount of 5 mg per gram of toner solids. After 2 hours, 40 mg per gram of toner solids of either basic barium petronate (BBP, Witco) or calcium petronate (CAP 25H, Witco), are added to the toner. Results in terms of charging parameters are shown in Table 4.

TABLE 4

Conductivity of Spherical Toner Particles with BBP and CAP Charge Directors

| Charge Director | % A293A | particle conductivity (pmho/cm) | low field conductivity (pmho/cm) | polarity |
|---|---|---|---|---|
| BBP | 0 | 1 | 12 | + |
| CAP | 0 | 2 | 14 | – |
| BBP | 5 | 24 | 6 | – |
| CAP | 5 | 17 | 5 | – |

Note: Conductivity in pmho/cm
The toners containing A293A gave very good copy quality when used in a duplicator, whereas in absence of A293A the copies were unreadable.

EXAMPLE 4 toner Comprising Polymer with Bi-anino Groups (a) Acryloid DM55 (600 g), an acrylic resin containing tertiary amino groups marketed by Rohm and Haas, is ground cryogenically to form a fine powder, which is then transferred to a 1S attritor (Union Process) together with 1200 g Isopar L. The mixture is ground for 24 hours at room temperature, while cooling with water. The resultant particles had a median size of 1.4 $\mu$m.

(b) The product of part (a), after appropriate dilution (300 g of 2% n.v.s.) was placed in a vessel, subjected to the action of a Ross Model Lab-ME high shear mixer at 40° C., and an Isopar L solution of 10% by weight ionomer (AClyn 291A, preheated at 115° C., the ionomer constituting either 10 or 20% by weight of the toner solids), is slowly added, after which maximum shear is applied for 3 minutes. The dispersion is allowed to cool and equilibrate for 1 hour and then Lubrizol 890 is added in an amount of 100 mg charge director per gram of toner solids. The product is then allowed to equilibrate for a further 2 hours, after which time the charging parameters are measured.

Results are shown in Table 5, from which it may be seen that use of the ionomer (i) markedly increases the chargeability of the toner particles (by an order of magnitude as seen in the high field conductivity data), with the consequence that the toner is satisfactory for use in an imager, and (ii) reverses the polarity of the toner particles. The particle conductive of Run Nos. 1, 2 and 3 are 7 pmho/cm, 86 pmho/cm and 103 pmho/cm, respectively.

TABLE 5

Conductivity of DM55 Toner Particles

| Run No. | % A291A | conductivity (pmho/cm) low field | high field | polarity |
|---|---|---|---|---|
| 1 | 0 | 5 | 12 | 100% (+) |
| 2 | 10 | 12 | 98 | 100% (–) |
| 3 | 20 | 12 | 115 | 100% (–) |

While the present invention has been particularly described, persons skilled in the art will appreciate that many variations and modifications can be made. Therefore, the invention is not to be construed as restricted to the particularly described embodiments, rather the scope, spirit and concept of the invention will be more readily understood by reference to the claims which follow.

What is claimed is:

1. A liquid toner for electrostatic development of electrostatic images which comprises:

an insulating non-polar carrier liquid;

at least one charge director; and toner particles dispersed in the carrier liquid, the particles comprising:

a core material comprising a pigmented polymer suitable for use as a toner material in an electrostatic image development application, but which is unchargeable by the at least one charge director or which is chargeable by the at least one charge director to less than or equal to 7 pmho/cm; and a coating of at least one ionomer component in an amount effective to impart enhanced chargeability to the pigmented polymer to an extent that the particles can be used to develop a latent electrostatic image in the electrostatic image development application.

2. Liquid toner according to claim 1, wherein the particles are synthetic resin particles.

3. Liquid toner according to claim 1 wherein the at least one ionomer is carboxylic acid based and neutralized with metal salts forming ionic clusters.

4. Liquid toner according to claim 1 wherein the at least one ionomer is methacrylic acid based and neutralized with metal salts forming ionic clusters.

5. Liquid toner according to claim 1 wherein the at least one ionomer is sulfonic acid based and neutralized with metal salts forming ionic clusters.

6. Liquid toner according to claim 1 wherein the at least one ionomer is phosphoric acid based and neutralized with metal salts forming ionic clusters.

7. Liquid toner according to claim 1 wherein the at least one ionomer is ethylene based and neutralized with metal salts forming ionic clusters.

8. Liquid toner according to claim 1 wherein the costing comprises less than 20 percent of the weight of the particles.

9. Liquid toner according to claim 1 wherein the coating comprises len. then 10 percent of the weight of the particles.

10. Liquid toner according to claim 1 wherein the coating comprises less than 5 percent of the weight of the particles.

11. A method according to claim 1 wherein the coating comprises a thickness greater than or equal to a monolayer of the at least one ionomer.

12. Liquid toner according to claim 11 wherein the coating comprises a thickness of greater than 0.02 micrometers.

13. An electrostatic imaging process which comprises:

forming a charged latent electrostatic image on a photoconductive surface;

applying to the surface toner particles from a liquid toner according to claim 1; and transferring the resulting toner image to a substrate.

14. Liquid toner according to claim 1 wherein the core material is chargeable by the at least one charge director to less than or equal to 3 pmho/cm.

15. Liquid toner according to claim 1 wherein the core material is chargeable by the at least one charge director to less than or equal to 2 pmho/cm.

16. Liquid toner according to claim 1 wherein the core material is chargeable by the at least one charge director to less than or equal to 1 pmho/cm.

17. A liquid toner for electrostatic imaging which comprises:

an insulating non-polar carrier liquid;

at least one charge director; and toner particles dispersed in the carrier liquid, the toner particles conprising:

a core material which is chargeable to a fire polarity by the at least one charge director; and a coating of at least one ionomer component in an amount effective, together with the at least on e charge director, to impart a charge having a polarity different from the first polarity to the coated particles.

18. A method for producing liquid toners for electrostatic imaging utilizing an electrostatic imaging method, which method comprises dispersing pigmented polymer particles in insulating non-polar carrier liquid, mixing at least one ionomer which is not soluble at room temperature with the liquid, coating the polymer particles with the at least one ionomer, and adding at least one charge director to the liquid, wherein the pigmented polymer comprises a material suitable for use as a toner material in an electrostatic image development application, but which in the presence of charge director alone is unchargeable or chargeable by the at least one charge director to less than or equal to 7 phmo/cm, and the at least one ionomer is used in an amount effective to impart enhanced chargeability to the toner particles to an extent that the particles can be used to develop a latent electrostatic image in the electrostatic imaging development application.

19. The method according to claim 18 wherein the core material is chargeable by the at least one charge director to less than or equal to 3 pmho/cm.

20. The method according to claim 18 wherein the core material is chargeable by the at least one charge director to less than or equal to 2 pmho/cm.

21. The method according to claim 18 wherein the core material is chargeable by the at least one charge director to less than or equal to 1 pmho/cm.

22. A method according to claim 18, wherein the at least one ionomer is first heated to a temperature at which the at least one ionomer dissolves in the carrier liquid and then cooled to a temperature where the at least one ionomer is not soluble in the carrier liquid, thereby coating the particles with the at least one ionomer.

23. A method according to claim 22, wherein the liquid is agitated at least during cooling.

24. A method according to claim 23, wherein the at least one charge director is added to the liquid after cooling.

25. A method according to claim 18, wherein the particles are comprised of a synthetic resin.

26. A method according to claim 18, wherein the at least one ionomer is carboxylic acid based and neutralized with metal salts forming ionic clusters.

27. A method according to claim 18, wherein the at least one ionomer is methacrylic acid based and neutralized with metal salts forming ionic clusters.

28. A method according to claim 18, wherein the at least one ionomer is sulfonic acid based and neutralized with metal salts forming ionic clusters.

29. A method according to claim 18, wherein the at least one ionomer is phosphoric acid based and neutralized with metal salts forming ionic clusters.

30. A method according to claim 18, wherein the at least one ionomer is ethylene based and neutralized with metal salts forming ionic clusters.

31. An electrostatic imaging process which comprises:

forming a charged latent electrostatic image on a photoconductive surface;

applying to the surface charged particles from a liquid toner prepared according to the method of claim 14; and transferring the resulting toner image to a substrate.

32. A method for producing liquid toners for electrostatic imaging utilizing an electrostatic imaging method, which method comprises dispersing pigmented polymer particles in insulating non-polar carrier liquid, mixing at least one ionomer which is not soluble at room temperature with the liquid, coating the polymer particles with the at least one ionomer, and adding at least one charge director to the liquid, wherein the at least one ionomer is used in an amount effective to reverse the negative polarity imparted to the material of the particles by the at least one charge director.

* * * * *